US006630103B2

(12) United States Patent
Martin et al.

(10) Patent No.: US 6,630,103 B2
(45) Date of Patent: Oct. 7, 2003

(54) ULTRA-HIGH-STRENGTH PRECIPITATION-HARDENABLE STAINLESS STEEL AND STRIP MADE THEREFROM

(75) Inventors: James W. Martin, Sinking Spring, PA (US); Theodore Kosa, Reading, PA (US)

(73) Assignee: CRS Holding, Inc., Wilmington, DE (US)

( * ) Notice: Subject to any disclaimer, the term of this patent is extended or adjusted under 35 U.S.C. 154(b) by 0 days.

(21) Appl. No.: 10/106,661

(22) Filed: Mar. 26, 2002

(65) Prior Publication Data

US 2003/0049153 A1 Mar. 13, 2003

Related U.S. Application Data

(60) Provisional application No. 60/279,007, filed on Mar. 27, 2001.

(51) Int. Cl.[7] ..... C22C 38/52; C22C 38/44

(52) U.S. Cl. ..... 420/38; 148/325; 148/326; 148/327

(58) Field of Search ..... 148/325, 326, 148/327; 420/38

(56) References Cited

U.S. PATENT DOCUMENTS

| | | | |
|---|---|---|---|
| 5,512,237 | A | 4/1996 | Stigenberg |
| 5,533,982 | A | 7/1996 | Rizk et al. |
| RE36,382 | E | 11/1999 | Hultin-Stigenberg |

FOREIGN PATENT DOCUMENTS

| | | |
|---|---|---|
| GB | 1056561 | 1/1967 |
| GB | 1021405 | 3/1996 |
| WO | WO 99/07910 | 2/1999 |

*Primary Examiner*—Deborah Yee
(74) *Attorney, Agent, or Firm*—Dann, Dorfman, Herrell and Skillman, P.C.

(57) ABSTRACT

A precipitation hardenable stainless steel having the following weight percent composition is disclosed.

| | |
|---|---|
| C | 0.030 max. |
| Mn | 0.5 max. |
| Si | 0.5 max. |
| P | 0.040 max. |
| S | 0.025 max. |
| Cr | 9–13 |
| Ni | 7–9 |
| Mo | 3–6 |
| Cu | 0.75 max. |
| Co | 5–11 |
| Ti | 1.0 max. |
| Al | 1.0–1.5 |
| Nb | 1.0 max. |
| B | 0.010 max. |
| N | 0.030 max. |
| O | 0.020 max. |

The balance of the alloy is essentially iron and the usual impurities. One or more rare earth metals or calcium may be included in the alloy for removing and/or stabilizing phosphorus and sulfur. The alloy provides a unique combination of strength, toughness, and ductility. In accordance with another aspect of the present invention, there is described a useful article such as an aircraft structural component or a golf club head that is formed, at least in part, from the aforesaid alloy. In accordance with a further aspect of the present invention, there is described an elongated strip formed from the aforesaid and a method of making such strip material.

32 Claims, No Drawings

ULTRA-HIGH-STRENGTH PRECIPITATION-HARDENABLE STAINLESS STEEL AND STRIP MADE THEREFROM

This application claims the benefit of priority from copending U.S. Provisional Application No. 60/279,007, filed Mar. 27, 2001.

FIELD OF THE INVENTION

This invention relates to precipitation-hardenable, martensitic stainless steel alloys, and in particular to a Cr—Co—Ni—Mo—Al martensitic stainless steel alloy, and a useful article made therefrom, having a unique combination of high strength, notch ductility, fracture toughness, and corrosion resistance.

BACKGROUND OF THE INVENTION

Hitherto, many industrial applications, particularly in the aerospace industry, have utilized structural components manufactured from steel alloys that provide very high strength together with high toughness and ductility. Some of those applications also require good corrosion resistance for components that are exposed to corrosive or oxidizing media in their service environments. More recently, a need has arisen in the aerospace industry for a corrosion resistant steel alloy that provides higher levels of tensile strength (i.e., greater than about 260 ksi) together with high toughness and ductility.

Another field which has generated a great demand for very high strength materials is the golf club industry. In recent years there has been an unprecedented development in golf club design and technology. The new designs have generated a need for ever stronger materials. Because golf is played in the outdoors, it is desirable that any material used for golf club heads be corrosion resistant. Among the early materials used for this application were aluminum and precipitation-hardenable stainless steel. However, as club head design has evolved in recent years, manufacturers have developed new demands for strength and ductility. Among the newer technologies for golf clubs is the multi-material design in which the golf club head is fabricated from multiple pieces each made from a different material. In those designs the material used to form the face of the club has very high strength and hardness. However, because it is formed from strip material, it should also be reasonably malleable so that it can be readily processed to strip form.

Among the known high strength, high toughness steel alloys are the 300M alloy and the AERMET® 100 alloy. Both of those alloys are capable of providing tensile strength levels well in excess of 260 ksi, together with good fracture toughness. However, because those alloys contain relatively low amounts of chromium (i.e., less than about 5% by weight), they lack the corrosion resistance afforded by stainless steels. Consequently, in order to use these very high strength, high toughness steels in environments containing even the mildest corrosive media, the parts must be coated or plated with a corrosion resistant material.

Stainless steels which provide a combination of high strength and corrosion resistance are known. In particular, precipitation-hardenable stainless steels are known which can provide a tensile strength in excess of 260 ksi as well as resistance to corrosion in most types of corrosive media. The precipitation-hardenable stainless steels achieve high hardness and strength through an age-hardening heat treatment in which a strengthening phase is formed in the ductile matrix of the alloy.

One of the known age-hardenable stainless steels is capable of providing good notch ductility (NTS/UTS≧1) and good tensile ductility at a tensile strength of up to about 260 ksi. However, the notch ductility of that alloy leaves something to be desired when the alloy is processed to provide a tensile strength in excess of 260 ksi. Another known age-hardenable stainless steel is capable of providing good ductility and toughness at a tensile strength of 260 ksi and higher. However, in order to achieve strength levels much in excess of 260 ksi, for example, up to about 300 ksi, the alloy must undergo strain hardening (i.e., cold working) prior to the aging heat treatment.

A further type of stainless steel that is designed to provide relatively high strength is the so-called "straight" martensitic stainless steel. Such steels achieve high strength when they are quenched from a solution or austenitizing temperature and then tempered. One such steel is designed to provide a tensile strength in excess of 260 ksi in the quenched and tempered condition. However, the utility of that steel is limited by the fact that it has a relatively large spread between its 0.2% offset yield strength and its ultimate tensile strength. For example, at a tensile strength of about 260 ksi, the attainable yield strength is only about 200 ksi.

Given the foregoing, it would be desirable to have an alloy which provides an improved combination of very high strength and corrosion resistance, without sacrificing much in the way of toughness and ductility, and which does not require special thermomechanical processing to achieve the desired mechanical properties.

SUMMARY OF THE INVENTION

The need for a corrosion resistant alloy that provides a superior combination of strength, notch ductility, and toughness compared to the known high strength stainless steels is essentially fulfilled by the precipitation hardenable, martensitic stainless steel alloy in accordance with the present invention. The alloy according to the present invention is an ultra-high strength, precipitation hardenable stainless steel that provides a unique combination of high strength, notch ductility, fracture toughness, and corrosion resistance, without the need for special thermomechanical processing. The broad, intermediate, and preferred compositional ranges of the steel alloy of the present invention are as follows, in weight percent:

| | Broad | Intermediate | Preferred |
|---|---|---|---|
| C | 0.030 max. | 0.020 max. | 0.015 max. |
| Mn | 0.5 max. | 0.25 max. | 0.10 max. |
| Si | 0.5 max. | 0.25 max. | 0.10 max. |
| P | 0.040 max. | 0.015 max. | 0.010 max. |
| S | 0.025 max. | 0.010 max. | 0.005 max. |
| Cr | 9–13 | 10–12 | 10.5–11.5 |
| Ni | 7–9 | 7.5–9 | 7.5–8.5 |
| Mo | 3–6 | 4–5.25 | 4.75–5.25 |
| Cu | 0.75 max. | 0.50 max. | 0.25 max. |
| Co | 5–11 | 7–11 | 8–9 |
| Ti | 1.0 max. | 0.1 max. | 0.005–0.05 |
| Al | 1.0–1.5 | 1.0–1.4 | 1.1–1.3 |
| Nb | 1.0 max. | 0.3 max. | 0.20 max. |
| B | 0.010 max. | 0.001–0.005 | 0.0015–0.0035 |
| N | 0.030 max. | 0.015 max. | 0.010 max. |
| O | 0.020 max. | 0.005 max. | 0.003 max. |

The alloy according to this invention optionally contains a small amount of one or more rare earth elements (REM), up to about 0.025% max., or a small amount of calcium or magnesium, up to about 0.010% max., for reducing phosphorus and/or sulfur in the alloy. The balance of the alloy is essentially iron, except for the usual impurities found in commercial grades of precipitation-hardenable stainless steels and minor amounts of other elements which may vary from a few thousandths of a percent up to larger amounts that do not objectionably detract from the desired combination of properties provided by this alloy.

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the element ranges of the broad composition can be used with one or more of the other ranges for the remaining elements in the preferred composition. In addition, a minimum or maximum for an element of one preferred embodiment can be used with the maximum or minimum for that element from another preferred embodiment. Throughout this application, percent or the symbol % shall mean percent by weight, unless otherwise indicated.

In accordance with another aspect of the present invention, there is provided a useful article such as an aircraft structural component or a golf club head that is formed, at least in part, from the aforesaid alloy.

In accordance with a further aspect of the present invention, there is provided an elongated strip formed from the aforesaid and a method of making such strip material.

DETAILED DESCRIPTION

The precipitation-hardenable, stainless steel alloy according to this invention contains at least about 9% chromium, better yet at least about 10% chromium, and preferably at least about 10.5% chromium to impart a suitable measure of corrosion resistance under oxidizing conditions. Too much chromium adversely affects the toughness and phase stability of this alloy. Therefore, chromium is restricted to no more than about 13%, better yet to no more than about 12%, and preferably to no more than about 11.5% in this alloy.

Cobalt promotes the formation of austenite in this alloy and benefits the toughness of the alloy. Cobalt also participates in the age hardening of the alloy by combining with other elements to form "R" phase, a Co—Mo—Cr—rich precipitate. Therefore, at least about 5%, better yet at least about 7%, and preferably at least about 8% cobalt is present in this alloy.

An excess of cobalt leads to a reduction in the strength provided by this alloy because too much cobalt overstabilizes the austenite, and thus, inhibits a full martensitic transformation. Of course, cobalt is a relatively expensive element and adds significantly to the cost of the alloy. For the foregoing reasons, cobalt is restricted to no more than about 11% and preferably to no more than about 9% in this alloy.

Nickel, like cobalt, is present in this alloy to promote austenite formation and benefit the toughness property. Also, nickel contributes to the age hardening of the alloy by forming a nickel-aluminum precipitate during the age hardening process. To achieve these objectives, at least about 7%, and preferably at least about 7.5% nickel is present in the alloy. Because of nickel's strong effect on suppressing martensitic transformation, the amount of nickel in the alloy is restricted to no more than about 9%, and preferably to no more than about 8.5%

Molybdenum is present in the alloy because it contributes to strength through its role in the formation of R-phase. Molybdenum also benefits the toughness, ductility, and corrosion resistance provided by this alloy. Accordingly, at least about 3%, better yet at least about 4%, and preferably at least about 4.75% molybdenum is present in this alloy. Too much molybdenum results in retained austenite and the formation of ferrite, both of which are undesirable. Therefore, molybdenum is restricted to no more than about 6%, and preferably to no more than about 5.25% in this alloy.

At least about 1.0%, and preferably at least about 1.1% aluminum is present in this alloy because aluminum contributes to strength through the formation of a nickel-aluminum strengthening precipitate during the aging process. However, too much aluminum adversely affects the toughness and ductility of this alloy. Therefore aluminum is restricted to no more than about 1.5%, better yet to no more than about 1.4%, and preferably to no more than about 1.3% in the alloy of this invention.

In addition to the foregoing, the following elements may be present in this alloy as optional additions for particular purposes. Titanium and/or niobium may be present in the alloy because they benefit the very high strength provided by this alloy. In this regard, titanium and niobium partially substitute for aluminum in the nickel-aluminum phase that precipitates in the alloy during the age hardening heat treatment. To that end the alloy may contain an effective amount up to about 1.0% titanium and/or an effective amount up to about 1.0% niobium. When present in this alloy, titanium is preferably limited to not more than about 0.1%, and better yet to not more than about 0.05%. Preferably, the alloy contains at least about 0.005% titanium to aid in stabilizing carbon and particularly nitrogen to thereby limit the formation of undesirable aluminum nitrides. When present, niobium is preferably limited to not more than about 0.3%, and better yet to not more than about 0.20% in this alloy.

A small amount of boron, up to about 0.010%, may be present in the alloy because of its beneficial effect on hot workability. In order to obtain the beneficial effect of boron, the alloy contains at least about 0.001% and preferably at least about 0.0015% boron. Boron is preferably restricted to not more than about 0.005%, and better yet to no more than about 0.0035% in this alloy.

The balance of the alloy is essentially iron and the usual impurities found in commercial grades of precipitation-hardenable stainless steels intended for similar service or use. The levels of such elements are controlled so as not to adversely affect the desired properties. In the alloy according to the present invention, carbon, nitrogen, and oxygen are intentionally limited to low levels because of their tendency to combine with other elements such as chromium, titanium, niobium, and especially aluminum in the case of nitrogen. In this regard, carbon is restricted to not more than about 0.030%, better yet to not more than about 0.020%, and preferably to not more than about 0.015%. Nitrogen is restricted to not more than about 0.030%, better yet to not more than about 0.015%, and preferably to not more than about 0.010%. Oxygen is restricted to not more than about 0.020%, better yet to not more than about 0.005%, and preferably to not more than about 0.003%.

Sulfur and phosphorus segregate to the grain boundaries of the alloy, which impairs grain boundary cohesion, and adversely affects the toughness and ductility of this alloy. This problem is particularly present when this alloy is produced in large section sizes. Consequently, the amount of sulfur present in the alloy is restricted to not more than 0.025%, better yet to no more than about 0.010%, and preferably to no more than about 0.005%. Phosphorus is restricted to no more than 0.040%, better yet to no more than 0.015%, and preferably to no more than 0.010%.

While sulfur and phosphorus can be reduced to very low levels through the selection of high purity charge materials and by employing alloy refining techniques, their presence in the alloy cannot be entirely avoided under large scale production conditions. Therefore, one or more rare earth metals (REM), particularly cerium, are preferably added in controlled amounts to combine with phosphorus and/or sulfur to facilitate the removal and stabilization of those two elements in the alloy. An effective amount of REM is present when the REM-to-sulfur ratio is at least about 1:1. Preferably, the REM-to-sulfur ratio is at least about 2:1. In this regard, the alloy preferably contains at least about 0.001% REM and better yet, at least about 0.002% REM. Too much REM recovery adversely affects the hot workability and the toughness of this alloy. Excessive REM content also results in the formation of undesirable oxide inclusions in the alloy. Therefore, the amount of REM present in this alloy is limited to not more than about 0.025%, better yet to not more than about 0.015%, and preferably to not more than about 0.010%, in this alloy. When used, the REM is added to the molten alloy in the form of mischmetal which is a mixture of rare earth elements, an example of which contains about 50% cerium, about 30% lanthanum, about 15% neodymium, and about 5% praseodymium.

As an alternative to REM, a small amount of calcium or magnesium can be added to this alloy during melting for the same purpose. When used, the retained amount of calcium or magnesium is restricted to not more than about 0.010% and preferably to not more than about 0.005% in this alloy.

Small amounts of manganese, silicon, and/or copper can be present in this alloy as residuals from alloying and/or deoxidizing additions used during melting of the alloy. Manganese and silicon are preferably kept at low levels because they can adversely affect the toughness and corrosion resistance of the alloy, and the austenite-martensite phase balance in the matrix material. Therefore, manganese and silicon are each restricted to not more than about 0.5%, better yet to no more than about 0.25%, and preferably to not more than about 0.10% in this alloy. Copper is not an essential element in this alloy and when too much is present it adversely affects the martensitic phase balance of the alloy. Therefore, copper is restricted to not more than about 0.75%, better yet to not more than about 0.50%, and preferably to not more than about 0.25% in this alloy.

Vacuum induction melting (VIM) followed by vacuum arc remelting (VAR) is the preferred method of melting and refining the alloy according to this invention. However, the alloy can be prepared by VIM alone for less critical applications. This alloy can also be made using powder metallurgy techniques, if desired. The molten alloy is preferably atomized using an inert gas such as argon. The alloy powder is filled into a container which is sealed and then consolidated, such as by hot isostatic pressing (HP). For best results, the powder-filled container is preferably hot-outgassed before being sealed.

A technique for making large section sizes of this alloy includes preparing small diameter bars of the alloy such that they are substantially free of segregation. Several of these small diameter bars are placed in a metal container so as to substantially fill the volume of the container. The container is closed, evacuated, and sealed and then consolidated by HIP to form a large diameter billet or bar product.

A cast ingot of this alloy is preferably homogenized at a temperature of about 2300° F. (1260° C.) and then hot worked from a temperature of about 2000° F. (1093° C.) to slab or large-section bar form. The slab or bar can be hot or cold worked further to obtain product forms having smaller cross-sectional sizes, such as bar, rod, and strip.

The very high strength provided by the precipitation hardenable alloy of the present invention is developed with multi-step heat treatment. The alloy is solution annealed at about 1700° F. (927° C.) for 1 hr. and then quenched in water. The alloy is preferably deep chilled at about −100° F. (−73°) for about 1–8 hrs., and then warmed in air to room temperature. The deep-chill treatment is preferably performed within 24 hours after the solution annealing treatment. The deep chill treatment cools the alloy to a temperature sufficiently below the martensite finish temperature to ensure the completion of the martensite transformation. However, the need for a deep chill treatment will be affected, at least in part, by the martensite finish temperature of the alloy. If the martensite finish temperature is sufficiently high, the transformation to a martensitic structure will proceed without the need for a deep chill treatment. In addition, the need for a deep chill treatment also depends on the size of the piece being manufactured. As the size of the piece increases, segregation in the alloy becomes more significant and the use of a deep chill treatment becomes more beneficial. Further, the length of time that the piece is chilled may need to be increased for large pieces in order to complete the transformation to martensite.

The alloy of the present invention is age hardened in accordance with techniques used for the known precipitation-hardening, stainless steel alloys, as known to those skilled in the art. Preferably, the alloy is aged at a temperature from about 950° F. (510° C.) to about 1100° F. (593° C.) for about 4 hours. The specific aging conditions used are selected by considering that the ultimate tensile strength of the alloy decreases as the aging temperature increases above about 1000° F. (538° C.).

The alloy of the present invention can be formed into a variety of wrought product shapes for a wide variety of uses and lends itself to the formation of billets, bars, rod, wire, strip, plate, or sheet using conventional practices. The alloy of the present invention is useful in a wide range of practical applications which require an alloy having a good combination of stress-corrosion cracking resistance, strength, and notch toughness. In particular, the alloy of the present invention can be used to produce structural members and fasteners for aircraft and the alloy is also well suited for use in medical or dental instruments. Further, the alloy is suitable for use in making cast parts for a wide variety of applications.

The alloy according to this invention is particularly desirable in the form of thin strip which can be machined into face inserts for golf club heads, particularly metal woods. Strip forms of this alloy can be readily processed to very high levels of hardness and strength.

A preferred method for producing strip product is as follows. A VIM/VAR ingot is first heated at about 1112 to 1292° F. (600 to 700° C.) for a time sufficient to overage the material, and then air cooled. For a typical production size ingot, the overaging can be accomplished in about 4 hours. The ingot is then heated to about 2300° F. (1260° C.) for a time sufficient to completely homogenize the ingot material. For a typical production size heat, this would be at least about 24 hours. The homogenized ingot is then hot worked from a temperature of about 1900 to 2200° F. (1038 to 1204° C.) to a first intermediate form such as slab or billet. The first intermediate form is hot worked again, preferably by hot rolling, from about 1950 to 2000° F. (1066 to 1093° C.) to a second intermediate form. The second intermediate form is heated to about 1112 to 1292° F. (600 to 700° C.) for about 4 hours to again overage the material. The second intermediate form is cold rolled to a penultimate size strip and then overaged again. The penultimate size strip is further cold rolled to final thickness.

After the final cold rolling step, the strip material is annealed at about 1796° F. (980° C.), preferably by a strand annealing process. The annealed strip is cold treated at −100° F. (−73° C.) for about 8 hours, and then warmed in air to room temperature. In the as-processed condition, the strip form of the alloy according to this invention provides a hardness of at least about 53 HRC a room temperature tensile strength of at least about 260 ksi.

A golf-club head utilizing strip material in accordance with the present invention is fabricated by joining a face member or insert with one or more other metal components that make up the heel, toe, sole, and top of the club head. The face member is machined from strip material formed from the alloy according to this invention as described above. The face member is preferably joined to the other components of the club head by welding or brazing. Since both of those techniques are conducted at very high temperatures, the hardness and strength of the face member is likely to be reduced from its as-produced condition. However, the alloy according to this invention retains substantial hardness and strength even after such elevated temperature joining techniques.

WORKING EXAMPLES

Example 1

A heat having the following weight percent composition was double vacuum melted (VIM/VAR): 0.001% carbon, <0.01% manganese, <0.01% silicon, <0.001% phosphorus, <0.0005% sulfur, 10.97% chromium, 7.99% nickel, 4.98% molybdenum, <0.01% copper, 8.51% cobalt, 0.02% titanium, 1.19% aluminum, <0.01% niobium, 0.0025% boron, <0.0005% nitrogen, <0.0005% oxygen, 0.004% cerium, 0.001% lanthanum, and the balance iron and usual impurities.

The VAR ingot was press forged to a 4½ in. wide by 1½ in. (11.4 cm by 3.8 cm) thick flat bar. Longitudinal (Long.) and transverse (Trans.) specimens for tensile, notch tensile, hardness, and fracture toughness testing were prepared from the forged bar material. One set (Set I) of the test specimens was heat treated as follows: annealed at 1700° F. (927° C.) for 1 hour and quenched with water; cold treated at −100° F. (−73° C.) for 1 hour; warmed in air; aged at 1000° F. (538° C.) for 4 hours, and then cooled in air to room temperature. A second set (Set II) of the test specimens was heat treated as follows: annealed at 1700° F. (927° C.) for 1 hour and quenched with water; cold treated at −100° F. (−73° C.) for 8 hours; warmed in air; aged at 1000° F. (538° C.) for 4 hours, and then cooled in air to room temperature.

The results of the testing of Example 1 are shown in Table 1 below, including the 0.2% offset yield strength (0.2% Y.S.) and the ultimate tensile strength (U.T.S.) in kilopounds per square inch (ksi), the percent elongation in four diameters (% El.), the reduction in area (% R.A.), the notch tensile strength (N.T.S.) in ksi, the Rockwell hardness (HRC), and the $K_{Ic}$ fracture toughness (F.T.) in ks; $\sqrt{1\ n}$.

TABLE 1

| Set | 0.2% Y.S. | U.T.S. | % El. | % R.A. | N.T.S. | HRC | F.T. |
|---|---|---|---|---|---|---|---|
| I (Long.) | 263 | 277 | 14 | 62 | 318 | 53 | 58 |
| I (Trans.) | 268 | 286 | 12 | 53 | 320 | 53 | 52 |
| II (Long.) | 267 | 283 | 12 | 54 | 284 | 53.5 | 51 |
| II (Trans.) | 269 | 286 | 12 | 51 | 309 | 53.3 | 50 |

Example 2

Examples 2A and 2B having the following weight percent compositions were VIM/VAR melted.

| Ex. | C | P | S | Cr | Ni | Mo | Co | Al | B | N | Ce | La |
|---|---|---|---|---|---|---|---|---|---|---|---|---|
| 2A | .005 | <.001 | <.0005 | 10.96 | 7.97 | 5.00 | 8.55 | 1.21 | .0032 | .0013 | .003 | .002 |
| 2B | .005 | <.001 | <.0005 | 11.14 | 8.01 | 4.99 | 8.62 | 1.22 | .0028 | .0010 | .006 | .002 |

The balance of each alloy is iron and impurities including <0.01% each of manganese, silicon, copper, titanium, and niobium, and <0.0010% oxygen.

The VAR ingot was hot rolled to 4½ in. wide by ¾ in. (11.4 cm by 1.9 cm) thick bar. Longitudinal (Long.) and transverse (Trans.) specimens for tensile, notch tensile, and hardness testing were prepared from the rolled bar material of each heat. The test specimens were heat treated as follows: annealed at 1700° F. (927° C.) for 1 hour and quenched with water; cold treated at −100° F. (−73° C.) for 8 hours; warmed in air; aged at 1000° F. (538° C.) for 4 hours, and then cooled in air to room temperature.

The results of the testing of Examples 2A and 2B are shown in Table 2 below, including the 0.2% offset yield strength (0.2% Y.S.) and the ultimate tensile strength (U.T.S.) in ksi, the percent elongation in four diameters (% El.), the reduction in area (% R.A.), the notch tensile strength (N.T.S.) in ksi, and the Rockwell hardness (HRC).

TABLE 2

| Example | 0.2% Y.S. | U.T.S. | % El. | % R.A. | N.T.S. | HRC |
|---|---|---|---|---|---|---|
| 2A (Long.) | 263 | 280 | 12 | 49 | 302 | 53.5 |
| 2A (Trans.) | 267 | 287 | 10 | 39 | 319 | — |
| 2B (Long.) | 269 | 283 | 13 | 53 | 321 | 53.5 |
| 2B (Trans.) | 274 | 289 | 10 | 39 | 299 | — |

Example 3

Example 3 having the following weight percent composition was VIM/VAR melted: 0.008% carbon, <0.01% manganese, <0.01% silicon, <0.005% phosphorus, 0.0006% sulfur, 11.01% chromium, 8.11% nickel, 5.06% molybdenum, <0.01% copper, 8.55% cobalt, 0.022% titanium, 1.18% aluminum, <0.01% niobium, 0.0021% boron, 0.0012% nitrogen, <0.0010 oxygen, and 0.0007% calcium. The balance was iron an impurities including <0.001% cerium and <0.001% lanthanum.

The VAR ingot was processed to 9.5 in. wide by 0.105 inch thick (24.13 cm by 2.67 mm) strip as described above and strand annealed at 1796° F. (980° C.) at a feed rate of about 3 feet per minute (1.5 cm/sec) through the annealing furnace. The annealed strip was cold treated at −100° F. (−73° C.) for 8 hours and then warmed in air. The strip material was then cold rolled to a thickness of about 0.100 inch (2.54 mm). Longitudinal (Long.) and transverse (Trans.) strip tensile specimens were prepared from the as-rolled material. Sets of duplicate specimens were aged for 4 hours at the following temperatures: 950° F. (510° C.), 975° F. (524° C.), 1000° F. (538°), 1025° F. (552° C.), 1050° F. (566° C.), and 1100° F. (593° C.). After aging, the specimens were cooled in air to room temperature.

The results of tensile testing of the duplicate specimens of Example 3 are shown in Table 3 below, including the 0.2% offset yield strength (0.2% Y.S.) and the ultimate tensile strength (U.T.S.) in ksi, the percent elongation in 2 inches (5 cm) (% El.). Also shown in Table 3 is the Rockwell hardness (HRC) which represents the average value of six (6) individual measurements on the test specimen.

TABLE 3

| Aging Temp. | Orientation | 0.2% Y.S. | U.T.S. | % El. | HRC |
|---|---|---|---|---|---|
| None | Long. | 151.7 | 164.9 | 9.9 | 34.5 |
| | | 151.5 | 165.2 | 9.7 | |
| | Trans. | 152.8 | 171.0 | 8.6 | |
| | | 151.8 | 170.2 | 8.6 | |
| 950° F. | Long. | 285.8 | 295.0 | 5.6 | 54.5 |
| | | 285.3 | 293.2 | 5.5 | |
| | Trans. | 284.9 | 295.6 | 4.5 | |
| | | 285.4 | 296.9 | 4.0 | |
| 975° F. | Long. | 284.2 | 294.7 | 5.5 | 55.0 |
| | | 282.7 | 292.7 | 5.4 | |
| | Trans. | 287.2 | 300.8 | 5.5 | |
| | | 288.8 | 301.8 | 5.5 | |
| 1000° F. | Long. | 271.3 | 285.1 | 6.8 | 55.0 |
| | | 273.5 | 287.1 | 6.3 | |
| | Trans. | 276.8 | 291.0 | 6.5 | |
| | | 277.7 | 293.1 | 5.8 | |
| 1025° F. | Long. | 253.8 | 272.5 | 9.0 | 54.0 |
| | | 252.5 | 271.2 | 8.8 | |
| | Trans. | 256.8 | 276.0 | 7.1 | |
| | | 259.3 | 277.2 | 7.6 | |
| 1050° F. | Long. | 238.8 | 261.1 | 8.9 | 53.0 |
| | | 241.6 | 263.1 | 9.2 | |
| | Trans. | 243.8 | 264.1 | 8.9 | |
| | | 243.7 | 265.1 | 8.9 | |
| 1100° F. | Long. | 198.7 | 231.9 | 12.7 | 49.0 |
| | | 199.6 | 232.4 | 12.5 | |
| | Trans. | 204.3 | 235.0 | 10.8 | |
| | | 205.3 | 235.4 | 11.2 | |

The results shown in Tables 1, 2, and 3, show the excellent combination of high strength, hardness, and toughness that is provided by the alloy according to this invention.

The terms and expressions that have been employed herein are used as terms of description and not of limitation. There is no intention in the use of such terms and expressions to exclude any equivalents of the features described or any portions thereof. It is recognized, however, that various modifications are possible within the scope of the invention claimed.

What is claimed is:

1. A precipitation-hardenable, martensitic stainless steel alloy having a unique combination of strength, toughness and corrosion resistance, said alloy consisting essentially of, in weight percent, about

| | |
|---|---|
| C | 0.030 max. |
| Mn | 0.5 max. |
| Si | 0.5 max. |
| P | 0.040 max. |
| S | 0.025 max. |
| Cr | 9–13 |
| Ni | 7–9 |
| Mo | 3–6 |
| Cu | 0.75 max. |
| Co | 5–11 |
| Ti | 1.0 max. |
| Al | 1.0–1.5 |
| Nb | 1.0 max. |
| B | 0.010 max. |
| N | 0.030 max. |
| O | 0.020 max. |

and the balance is essentially iron.

2. A precipitation-hardenable, martensitic stainless steel alloy as set forth in claim 1 which contains at least about 10% chromium.

3. A precipitation-hardenable, martensitic stainless steel alloy as set forth in claim 1 which contains at least about 7.5% nickel.

4. A precipitation-hardenable, martensitic stainless steel alloy as set forth in claim 1 which contains not more than about 5.25% molybdenum.

5. A precipitation-hardenable, martensitic stainless steel alloy as set forth in claim 1 which contains not more than about 9% cobalt.

6. A precipitation-hardenable, martensitic stainless steel alloy as set forth in any of claims 1 to 5 which contains a small amount up to about 0.025%, of one or more rare earth metals that is effective to stabilize any sulfur and phosphorus in the alloy.

7. A precipitation-hardenable, martensitic stainless steel alloy as set forth in any of claims 1 to 5 which contains a small amount up to about 0.010%, of calcium or magnesium that is effective to stabilize any sulfur in the alloy.

8. A precipitation-hardenable, martensitic stainless steel alloy having a unique combination of strength, toughness and corrosion resistance, said alloy consisting essentially of, in weight percent, about

| | |
|---|---|
| C | 0.020 max. |
| Mn | 0.25 max. |
| Si | 0.25 max. |
| P | 0.015 max. |
| S | 0.010 max. |
| Cr | 10–12 |
| Ni | 7.5–9.0 |
| Mo | 4–5.25 |
| Cu | 0.50 max. |
| Co | 7–11 |
| Ti | 0.1 max. |
| Al | 1.0–1.4 |
| Nb | 0.3 max. |
| B | 0.001–0.005 |
| N | 0.015 max. |
| O | 0.005 max. |

and the balance is essentially iron.

9. A precipitation-hardenable, martensitic stainless steel alloy as set forth in claim 8 which contains not more than about 11.5% chromium.

10. A precipitation-hardenable, martensitic stainless steel alloy as set forth in claim 8 which contains not more than about 8.5% nickel.

11. A precipitation-hardenable, martensitic stainless steel alloy as set forth in claim 8 which contains not more than about 9% cobalt.

12. A precipitation-hardenable, martensitic stainless steel alloy as set forth in any of claims 8 to 11 which contains a small amount up to about 0.025%, of one or more rare earth metals that is effective to stabilize any sulfur and phosphorus in the alloy.

13. A precipitation-hardenable, martensitic stainless steel alloy as set forth in any of claims 8 to 11 which contains a small amount up to about 0.010%, of calcium or magnesium that is effective to stabilize any sulfur in the alloy.

14. A precipitation-hardenable, martensitic stainless steel alloy having a unique combination of strength, toughness and corrosion resistance, said alloy consisting essentially of, in weight percent, about

| | |
|---|---|
| C | 0.015 max. |
| Mn | 0.10 max. |
| Si | 0.10 max. |

-continued

| | |
|---|---|
| P | 0.010 max. |
| S | 0.005 max. |
| Cr | 10.5–11.5 |
| Ni | 7.5–8.5 |
| Mo | 4.75–5.25 |
| Cu | 0.25 max. |
| Co | 8.0–9.0 |
| Ti | 0.005–0.05 |
| Al | 1.1–1.3 |
| Nb | 0.20 max. |
| B | 0.0015–0.0035 |
| N | 0.010 max. |
| O | 0.003 max. |

and the balance essentially iron.

15. A precipitation-hardenable, martensitic stainless steel alloy as set forth in claim 14 which contains a small amount up to about 0.025%, of one or more rare earth metals that is effective to stabilize any sulfur and phosphorus in the alloy.

16. A precipitation-hardenable, martensitic stainless steel alloy as set forth in claim 14 which contains a small amount up to about 0.010%, of calcium or magnesium that is effective to stabilize any sulfur in the alloy.

17. Elongated strip material formed from a precipitation-hardenable, martensitic stainless steel alloy consisting essentially of, in weight percent, about

| | |
|---|---|
| C | 0.030 max. |
| Mn | 0.5 max. |
| Si | 0.5 max. |
| P | 0.040 max. |
| S | 0.025 max. |
| Cr | 9–13 |
| Ni | 7–9 |
| Mo | 3–6 |
| Cu | 0.75 max. |
| Co | 5–11 |
| Ti | 1.0 max. |
| Al | 1.0–1.5 |
| Nb | 1.0 max. |
| B | 0.010 max. |
| N | 0.030 max. |
| O | 0.020 max. |

and the balance is essentially iron.

18. Elongated strip material as set forth in claim 17 wherein the alloy contains at least about 10% chromium.

19. Elongated strip material as set forth in claim 17 wherein the alloy contains at least about 7.5% nickel.

20. Elongated strip material as set forth in claim 17 wherein the alloy contains not more than about 5.25% molybdenum.

21. Elongated strip material as set forth in claim 17 wherein the alloy contains not more than about 9% cobalt.

22. Elongated strip material as set forth in any of claims 17 to 21 wherein the alloy contains a small amount up to about 0.025%, of one or more rare earth metals that is effective to stabilize any sulfur and phosphorus in the alloy.

23. Elongated strip material as set forth in any of claims 17 to 21 wherein the alloy contains a small amount up to about 0.010%, of calcium or magnesium that is effective to stabilize any sulfur in the alloy.

24. Elongated strip material formed from a precipitation-hardenable, martensitic stainless steel alloy consisting essentially of, in weight percent, about

| | |
|---|---|
| C | 0.020 max. |
| Mn | 0.25 max. |
| Si | 0.25 max. |
| P | 0.015 max. |
| S | 0.010 max. |
| Cr | 10–12 |
| Ni | 7.5–9.0 |
| Mo | 4–5.25 |
| Cu | 0.50 max. |
| Co | 7–11 |
| Ti | 0.1 max. |
| Al | 1.0–1.4 |
| Nb | 0.3 max. |
| B | 0.001–0.005 |
| N | 0.015 max. |
| O | 0.005 max. |

and the balance is essentially iron.

25. Elongated strip material as set forth in claim 24 wherein the alloy contains not more than about 11.5% chromium.

26. Elongated strip material as set forth in claim 24 wherein the alloy contains not more than about 8.5% nickel.

27. Elongated strip material as set forth in claim 24 wherein the alloy contains not more than about 9% cobalt.

28. Elongated strip material as set forth in any of claims 24 to 27 wherein the alloy contains a small amount up to about 0.025%, of one or more rare earth metals that is effective to stabilize any sulfur and phosphorus in the alloy.

29. Elongated strip material as set forth in any of claims 24 to 27 wherein the alloy contains a small amount up to about 0.010%, of calcium that is effective to stabilize any sulfur in the alloy.

30. Elongated strip material formed from a precipitation-hardenable, martensitic stainless steel alloy consisting essentially of, in weight percent, about

| | |
|---|---|
| C | 0.015 max. |
| Mn | 0.10 max. |
| Si | 0.10 max. |
| P | 0.010 max. |
| S | 0.005 max. |
| Cr | 10.5–11.5 |
| Ni | 7.5–8.5 |
| Mo | 4.75–5.25 |
| Cu | 0.25 max. |
| Co | 8.0–9.0 |
| Ti | 0.005–0.05 |
| Al | 1.1–1.3 |
| Nb | 0.20 max. |
| B | 0.0015–0.0035 |
| N | 0.010 max. |
| O | 0.003 max. |

and the balance essentially iron.

31. Elongated strip material as set forth in claim 30 wherein the alloy contains a small amount up to about 0.025%, of one or more rare earth metals that is effective to stabilize any sulfur and phosphorus in the alloy.

32. Elongated strip material as set forth in claim 30 wherein the alloy contains a small amount up to about 0.010%, of calcium or magnesium that is effective to stabilize any sulfur in the alloy.

* * * * *